US009568152B2

(12) United States Patent
Pan et al.

(10) Patent No.: US 9,568,152 B2
(45) Date of Patent: Feb. 14, 2017

(54) LED TUBE HAVING INCREASED ILLUMINATION ANGLE

(71) Applicant: LUXUL TECHNOLOGY INCORPORATION, New Taipei (TW)

(72) Inventors: Cheng-Hung Pan, New Taipei (TW); Yung-Ta Hung, New Taipei (TW); Cheng-Hsien Chen, New Taipei (TW)

(73) Assignee: LUXUL TECHNOLOGY INCORPORATION, New Taipei (TW)

( * ) Notice: Subject to any disclaimer, the term of this patent is extended or adjusted under 35 U.S.C. 154(b) by 0 days.

(21) Appl. No.: 14/183,199

(22) Filed: Feb. 18, 2014

(65) Prior Publication Data

US 2015/0049475 A1 Feb. 19, 2015

(30) Foreign Application Priority Data

Aug. 15, 2013 (TW) ..... 102129256 A

(51) Int. Cl.

| | |
|---|---|
| ***F21V 7/20*** | (2006.01) |
| ***F21K 99/00*** | (2016.01) |
| ***F21V 19/00*** | (2006.01) |
| ***F21V 29/507*** | (2015.01) |

(52) U.S. Cl.

CPC ..... *F21K 9/175* (2013.01); *F21K 9/27* (2016.08); *F21V 19/0045* (2013.01); *F21V 29/507* (2015.01)

(58) Field of Classification Search

CPC ..... F21Y 2103/003; F21K 9/175; F21K 9/27; F21V 29/507; F21V 19/0045

USPC ..... 362/218, 225, 217.11, 217.12, 217.13

See application file for complete search history.

(56) References Cited

U.S. PATENT DOCUMENTS

| | | | | |
|---|---|---|---|---|
| 7,210,818 | B2 * | 5/2007 | Luk | H05B 33/0857 361/749 |
| 2002/0060526 | A1 * | 5/2002 | Timmermans | H05B 33/0803 315/246 |
| 2008/0290350 | A1 * | 11/2008 | Lin | F21K 9/27 257/88 |
| 2009/0200950 | A1 * | 8/2009 | Jensen | 315/113 |
| 2009/0219713 | A1 * | 9/2009 | Siemiet et al. | 362/218 |
| 2009/0323342 | A1 * | 12/2009 | Liu | F21K 9/00 362/249.02 |
| 2010/0079075 | A1 * | 4/2010 | Son | 315/152 |
| 2010/0091496 | A1 * | 4/2010 | Rodriguez | F21K 9/27 362/249.04 |
| 2010/0102729 | A1 * | 4/2010 | Katzir et al. | 315/113 |
| 2010/0103673 | A1 * | 4/2010 | Ivey et al. | 362/249.02 |
| 2010/0201269 | A1 * | 8/2010 | Tzou | F21V 23/006 315/51 |
| 2010/0284195 | A1 * | 11/2010 | Liu et al. | 362/373 |

(Continued)

*Primary Examiner* — Bryon T Gyllstrom

(74) *Attorney, Agent, or Firm* — Lynette Wylie; Apex Juris, pllc.

(57) ABSTRACT

An LED tube has a tube body, an LED light board and two caps. The tube body has a translucent tube shell and a heat dissipating seat. The translucent tube shell has two openings and a gap. The heat dissipating seat is mounted in the gap. The LED board faces toward the translucent tube shell and has a convex luminous surface obliquely facing toward the translucent tube shell to increase an illumination range of the LED light board, thus, an illumination angle of the LED tube in accordance with the present invention is also increased. Therefore, the LED tube glows evenly and eliminates grain effects of the LED tube.

18 Claims, 16 Drawing Sheets

(56) References Cited

U.S. PATENT DOCUMENTS

| | | | | |
|---|---|---|---|---|
| 2010/0302773 | A1* | 12/2010 | Kokoski | F21L 14/023 362/231 |
| 2011/0176297 | A1* | 7/2011 | Hsia | F21V 25/04 362/217.1 |
| 2011/0309745 | A1* | 12/2011 | Westermarck et al. | 315/51 |
| 2012/0008315 | A1* | 1/2012 | Simon | F21V 21/005 362/217.13 |
| 2012/0250301 | A1* | 10/2012 | Tung | F21V 31/00 362/223 |
| 2014/0301081 | A1* | 10/2014 | Lin | F21V 21/00 362/249.02 |

* cited by examiner

LED TUBE HAVING INCREASED ILLUMINATION ANGLE

BACKGROUND OF THE INVENTION

1. Field of the Invention

The present invention relates to an LED tube and more particularly to an LED tube having an increased illumination angle.

2. Description of Related Art

An LED has features of small volume, high luminous efficiency and long service life. Thus, LED tubes using LEDs as light sources have become more and more common.

With reference to FIGS. 15 and 16, a conventional LED tube has a heat dissipating seat 60, an LED light board 70, a translucent tube shell 80 and two caps 90.

The heat dissipating seat 60 is semi-cylindrical and has a rectangular flat surface, a convex surface, multiple fins 61 and two slide tracks 62. The rectangular flat surface has two opposite long sides and two opposite short sides. The multiple fins 61 are formed concave on the convex surface, and the two slide tracks 62 are respectively formed on two long sides of the flat surface.

The LED light board 70 is rectangular and has two opposite long sides, two opposite short sides vertically connected to the two long sides, four electrical connecting parts 71 and multiple LED units 72. The two long sides of the LED light board 70 are slidably mounted in the two slide tracks 62 respectively. Thus, the LED light board 70 is mounted on the flat surface of the heat dissipating seat 60, and the two short sides of the LED light board 70 are respectively in alignment with the two short sides of the flat surface. Each two of the four electrical connecting parts 71 are mounted on a corresponding short side of the LED light board 70. The multiple LED units 72 are mounted at intervals on the LED light board 70 in a longitudinal direction of the LED light board 70.

The translucent tube shell 80 is semi-cylindrical and is connected to the heat dissipating seat 60 to form a tube body, wherein the translucent tube shell 80 faces the multiple LED units 72 of the LED light board 70.

Each cap 90 is sleeved on a corresponding end of the tube body and has two electrode pins 91 respectively and electrically connected to two of the electrical connecting parts 71 which are adjacent to the corresponding end.

When the LED tube is mounted in a lamp holder and is switched on, the LED light board 70 obtains power through the four electrode pins 91 of the two caps 90 and glows by the multiple LED units 72. Heat produced by the functioning LED light board 70 is conducted to the heat dissipating seat 60 and further dissipated by the multiple fins 61.

One can observed that the multiple LED units 72 are arranged in a line and face the translucent tube shell 80 in a same direction. However, the multiple LED units 72 are unidirectional light sources having narrow illumination angles, thus, an illumination area of the LED light board 70 is also narrow. When the multiple LED units 72 glow, light produced by the LED light board 70 is focused on a side of the translucent tube shell 80 facing the multiple LED units 72. Therefore, luminance of the LED tube is not even causing grain effects of the LED tube.

Furthermore, each cap 90 is only sleeved on a corresponding end of the tube body consisting of the heat dissipating seat 60 and the translucent tube shell 80, that is, a connection between each cap 90 and the tube body is not stable. When an unexpected force works on the LED tube, the caps are easy to rotate and cause a deviation of the illumination angle of the LED tube.

SUMMARY OF THE INVENTION

The main objective of the invention is to provide an LED tube having an increased illumination angle.

The LED tube comprises a tube body, an LED light board and two caps. The tube body has a translucent tube shell and a heat dissipating seat. The translucent tube shell has two openings and a gap formed through the translucent tube shell in a longitudinal direction of the translucent tube shell. The heat dissipating seat is mounted in the gap. The LED light board is mounted in the tube body and has two opposite sides, two opposite ends, a concave back surface and a convex luminous surface opposite to the concave back surface. The two ends of the LED light board are connected to the two sides of the LED light board. The convex luminous surface faces and is convex toward the translucent tube shell, and the concave back surface abuts the heat dissipating seat. The two caps are respectively mounted on the two openings of the translucent tube shell, wherein each cap has at least one electrode pin electrically connected to the LED light board.

The convex luminous surface obliquely facing toward the translucent tube shell increases an illumination range of the LED light board, thus, an illumination angle of the LED tube in accordance with the present invention is also increased. Therefore, the LED tube glows evenly and eliminates grain effects of the LED tube.

Another objective of the invention is to provide an LED tube having caps firmly mounted on the LED tube.

The heat dissipating seat further comprises a top convex surface and a bottom surface. The bottom surface has multiple fins and two semi-annular grooves. The multiple fins are formed on the bottom surface and extend downward from the bottom surface. The two semi-annular grooves are respectively formed on two adjacent fins of the multiple fins and face each other. Each cap further comprises a screw having a screw head and a screw rod. The screw rod is mounted through the cap and between the two semi-annular grooves of the heat dissipating seat, and the screw head abuts the cap to screw the cap on a corresponding one of the two openings of the translucent tube shell.

In conclusion, the two caps are firmly mounted on the openings of the translucent tube shell via the two semi-annular grooves of the heat dissipating seat and the screws of the two caps.

DETAILED DESCRIPTION OF THE PREFERRED EMBODIMENTS

Figure 1:
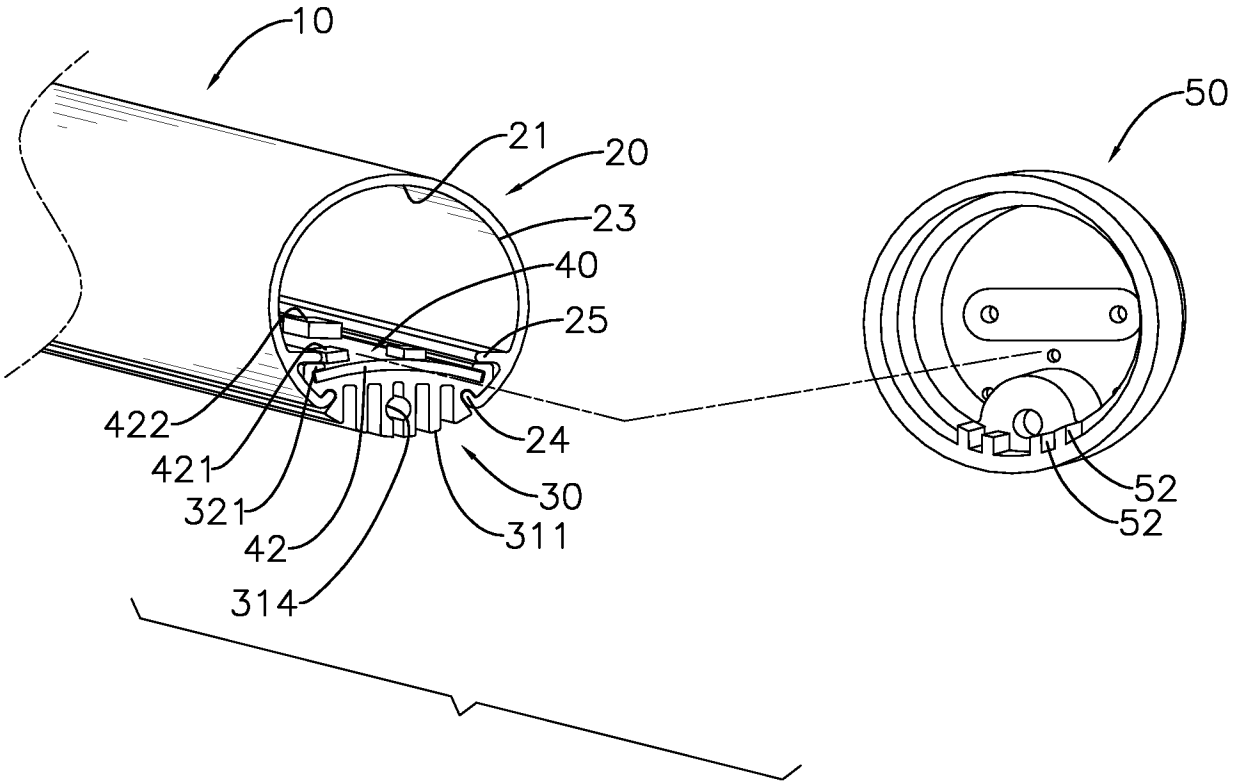
FIG. 1 is a partial exploded view of a first embodiment of an LED tube in accordance with the present invention.
Figure 2:
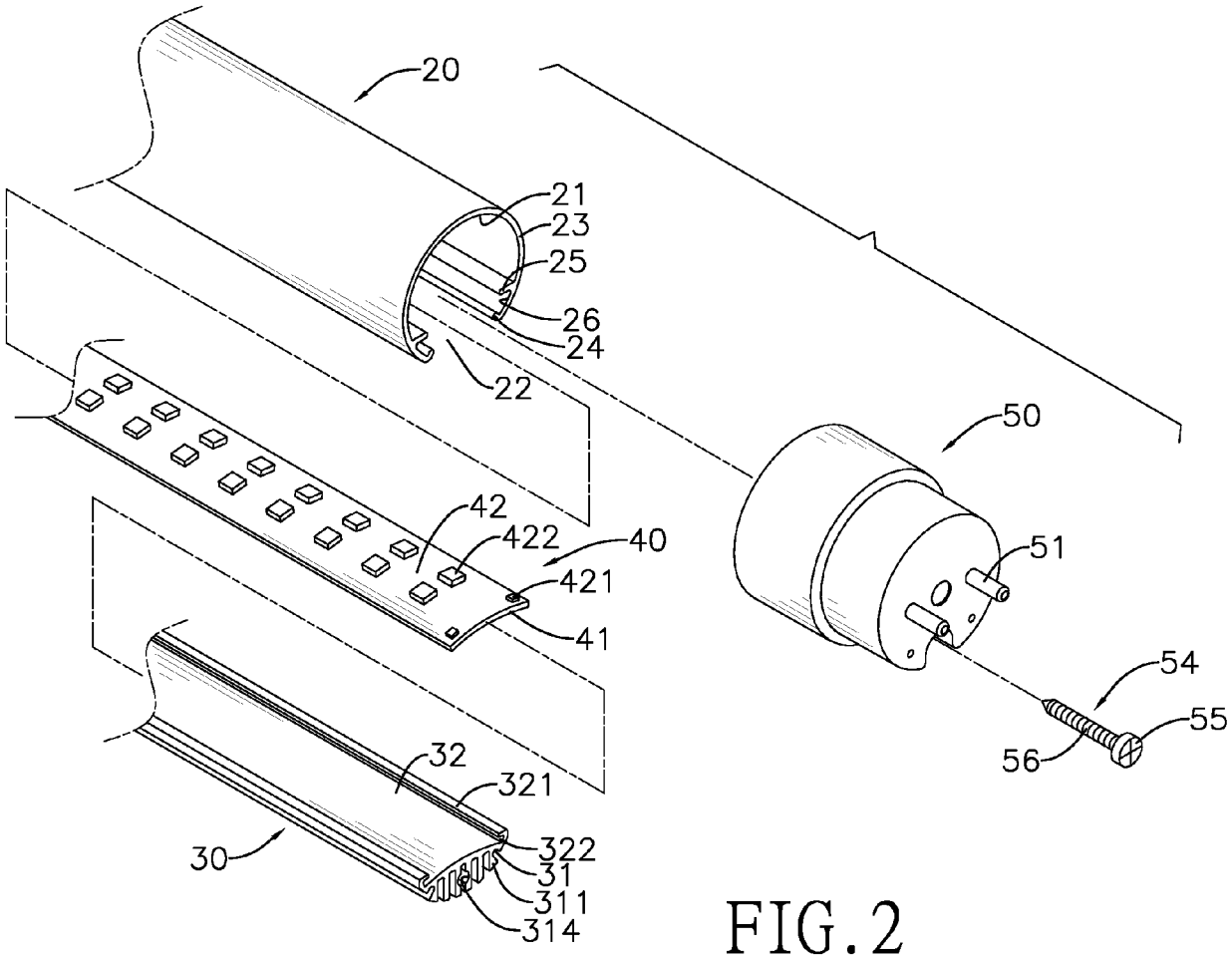
FIG. 2 is an exploded view of the LED tube in FIG. 1.
Figure 3:
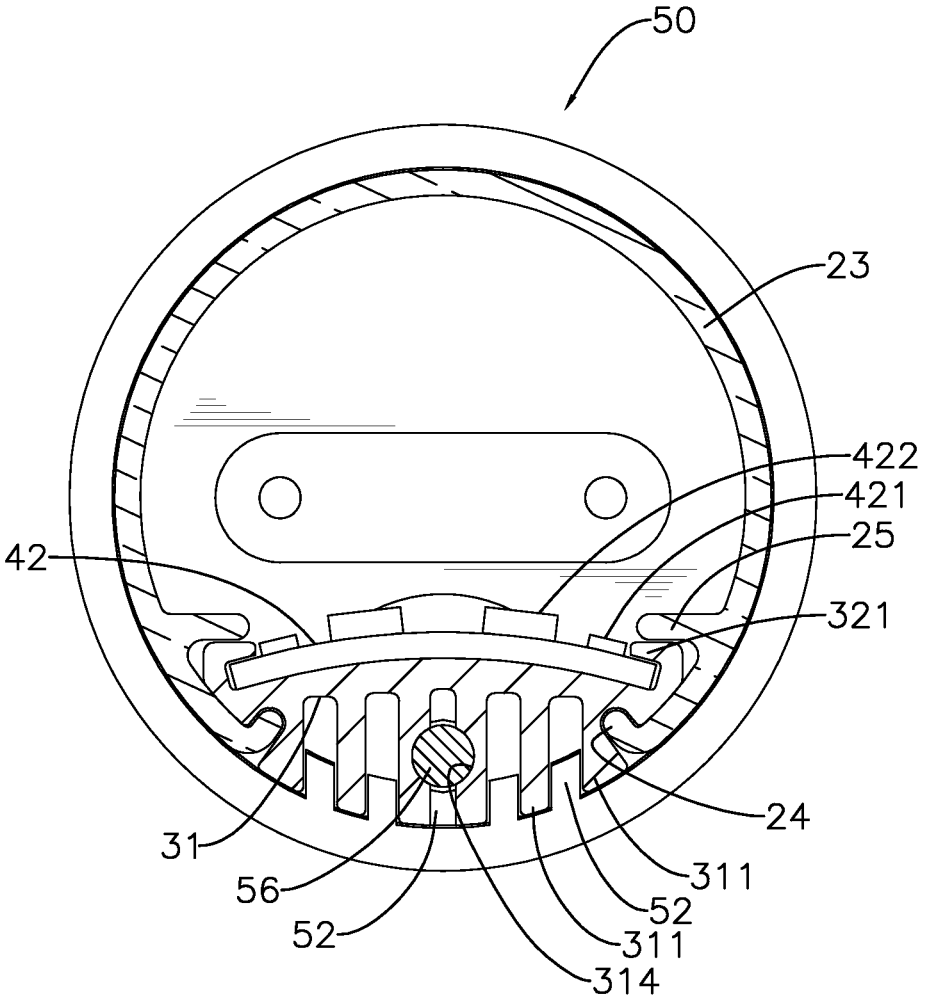
FIG. 3 is a side view in cross section of the LED tube in FIG. 1.
Figure 4:
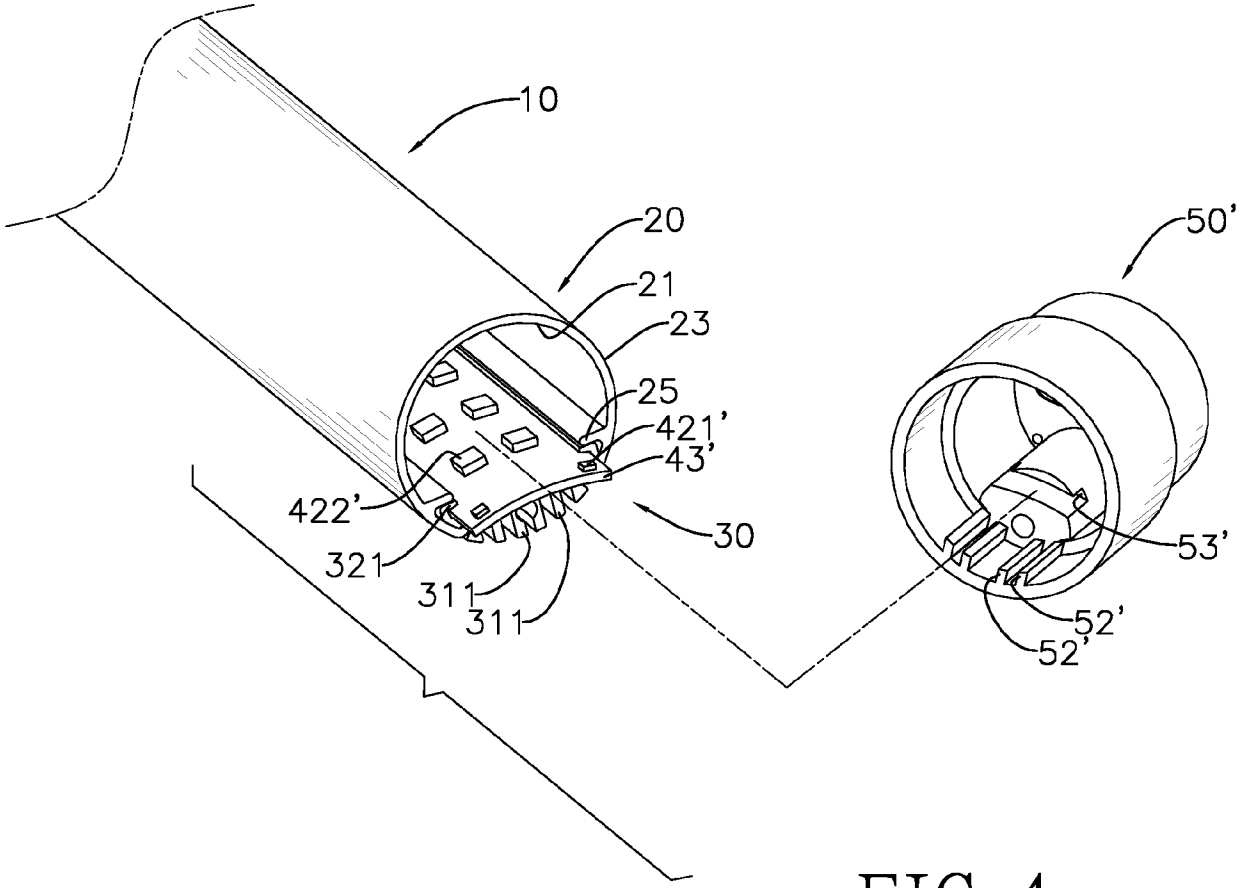
FIG. 4 is a partial exploded view of a second embodiment of an LED tube in accordance with the present invention.
Figure 5:
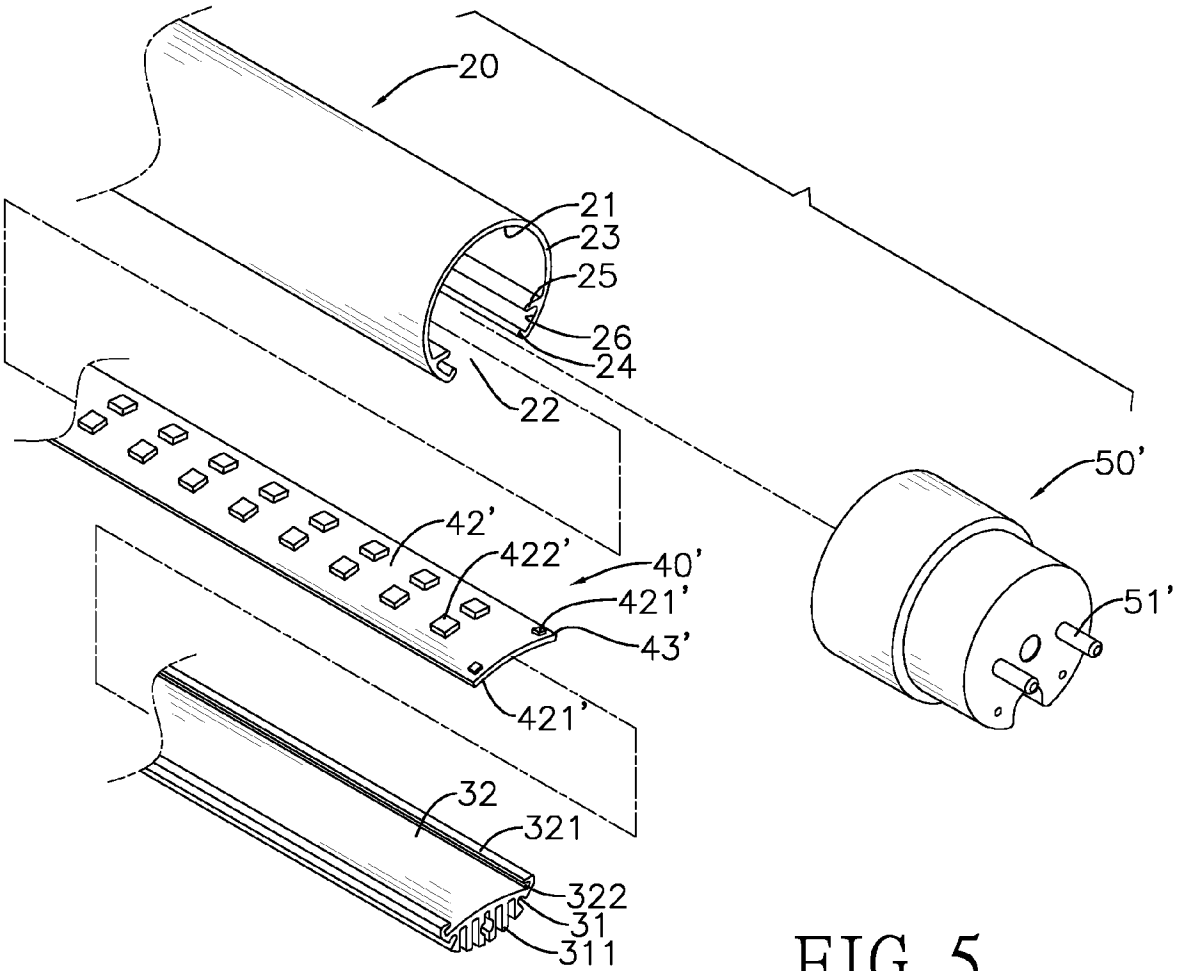
FIG. 5 is an exploded view of the LED tube in FIG. 4.

With reference to FIGS. 1 to 3, a first embodiment of an LED tube in accordance with the present invention comprises a tube body 10, an LED light board 40 and two caps 50.

The tube body 10 comprises a translucent tube shell 20 and a heat dissipating seat 30.

The translucent tube shell 20 is electrically insulating and has two openings 21, a gap 22 and two side walls 23, two first ribs 24, two second ribs 25 and two first slide tracks 26. The gap 22 is formed through the translucent tube shell 20 along a longitudinal direction of the translucent tube shell 20. The two side walls 23 are separated by the gap 22. The two first ribs 24 are respectively formed on the two side walls 23 and adjacent to the gap 22. The two second ribs 25 are respectively formed on the two side walls 23, and are respectively located above the two first ribs 24. Each first slide track 26 is formed between a corresponding one of the side walls 23, the first rib 24 formed on said corresponding side wall 23, and the second rib 25 formed on said corresponding side wall 23.

The heat dissipating seat 30 is mounted in the gap 22 of the translucent tube shell 20 and the heat dissipating seat 30 is made of metal. The heat dissipating seat 30 has two opposite sides in parallel to a longitudinal direction of the heat dissipating seat 30, a bottom surface 31 and a top convex surface 32 opposite to the bottom surface 31. The bottom surface 31 faces downward and has multiple fins 311 and two semi-annular grooves 314. The multiple fins 311 extend downward from the bottom surface 31. The two semi-annular grooves 314 are respectively formed on two adjacent fins 311 of the multiple fins 311 and face each other. The top convex surface 32 is convex toward the translucent tube shell 20, and has two slide bars 321 and two slide tracks 322. The two slide bars 321 extend upward from the top convex surface 32 and respectively along the two opposite sides of the heat dissipating seat 30, wherein the two slide tracks 322 are respectively formed concave on the two slide bars 321 and face each other.

The LED light board 40 is mounted in the tube body 10 and has two opposite sides slidably mounted in the two slide tracks 322 respectively, two opposite ends 43 connected to the two opposite sides of the LED light board 40, a concave back surface 41, and a convex luminous surface 42 opposite to the concave back surface 41. The two ends 43 are respectively near the two openings 21 of the translucent tube shell 20. The concave back surface 41 abuts the top convex surface 32 of the heat dissipating seat 30. The convex luminous surface 42 is convex toward the translucent tube shell 20 and has four electrical connecting parts 421 and multiple LED units 422. Each two electrical connecting parts 421 are mounted on the convex luminous surface 42 and near a corresponding end 43. The multiple LED units 422, 422' are mounted on the convex luminous surface 42, 42' and arranged in two lines, wherein the two lines of the LED units 422, 422' are mounted on two beveled faces separated by a midline on the convex luminous surface 42, 42'.

The caps 50 are respectively sleeved on the two openings 21 of the translucent tube shell 20. Each cap 50 has an inner wall, two electrode pins 51 and multiple fin fixing parts 52. The two electrode pins 51 are mounted through the cap 50 and are electrically connected to two corresponding ones of the electrical connecting parts 421 respectively. The multiple fin fixing parts 52 are formed on the inner wall of the cap 50, wherein each fin fixing part 52 is mounted between two adjacent fins 311 of the multiple fins 311. Furthermore, with reference to FIGS. 2 and 3, each cap 50 further has a screw 54, wherein the screw 54 has a screw head 55 and a screw rod 56 connected to the screw head 55. The screw rod 56 is mounted through the cap 50 and between the two semi-annular grooves 314 of the heat dissipating seat 30, and the screw head 55 abuts the cap 50 to screw the cap 50 on a corresponding one of the two openings 21 of the translucent tube shell 20.

In conclusion, the multiple LED units 422 mounted on the convex luminous surface 42 obliquely face the translucent tube shell 20 and increase an illumination range of the luminous surface 42. An illumination angle of the LED tube in accordance with the present invention is also increased. Therefore, the LED tube glows evenly and eliminates grain effects of the LED tube.

With reference to FIGS. 4 to 7, a second embodiment of an LED tube in accordance with the present invention comprises a tube body 10, an LED light board 40' and two caps 50', wherein a structure of the tube body 10 of the second embodiment is similar to that of the first embodiment. Therefore, the structure of the tube body 10 will not be repeated in the following paragraphs.

The LED light board 40' is mounted in the tube body 10 and has two opposite sides slidably mounted in the two slide tracks 322 respectively, two opposite ends 43' connected to the two sides of the LED light board 40', a concave back surface 41', and a convex luminous surface 42' opposite to the concave back surface 41'. The two ends 43' are respectively near the two openings 21 of the translucent tube shell 20. The concave back surface 41' abuts the top convex surface 32 of the heat dissipating seat 30. The convex luminous surface 42' is convex toward the translucent tube shell 20 and has four electrical connecting parts 421' and multiple LED units 422'. Each two electrical connecting parts 421' are mounted on the convex luminous surface 42' and near a corresponding one of the two ends 43' of the LED light board 40'. The multiple LED units 422' are mounted on the convex luminous surface 42' and arranged in two lines in parallel and respectively along two sides of the convex luminous surface 42', wherein the two lines of the multiple LED units 422' are separated by a midline on the convex luminous surface 42' and face toward the translucent tube shell 20 in two different directions. In this embodiment, a length of the LED light board 40' in a longitudinal direction of the LED light board 40' is longer than a length of the heat dissipating seat 30 in a longitudinal direction of the heat dissipating seat 30. Therefore, the two ends 43' of the LED light board 40' are extended out of the heat dissipating seat 30.

The caps 50' are respectively sleeved on the two openings 21 of the translucent tube shell 20. Each cap 50' has an inner wall, two electrode pins 51' and multiple fin fixing parts 52'. The two electrode pins 51' are mounted through the cap 50' and are electrically connected to two corresponding ones of the electrical connecting parts 421' respectively. The multiple fin fixing parts 52' are formed on the inner wall of the cap 50', wherein each fin fixing part 52' is mounted between two adjacent fins 311 of the multiple fins 311. In this embodiment, each cap 50' further has a board fixing groove 53', wherein each end 43' of the LED light board 40' is mounted in a corresponding one of the board fixing grooves 53'.

Figure 6:
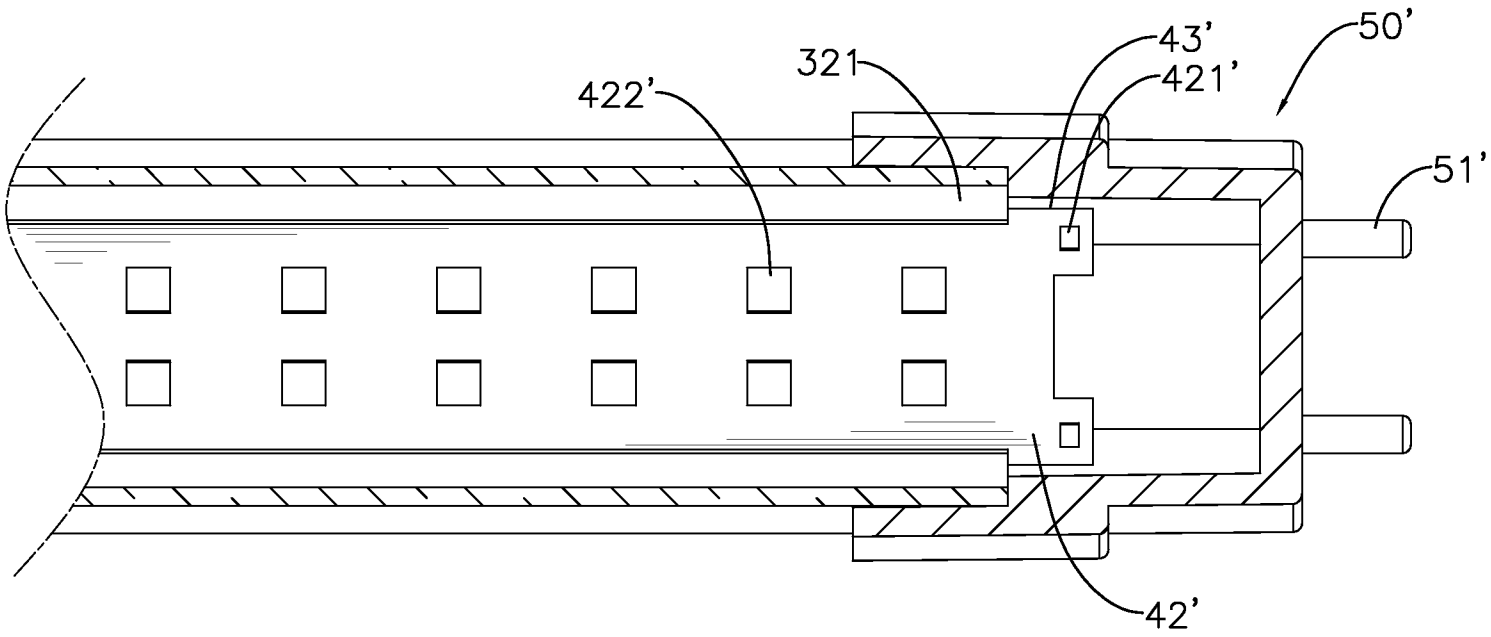
FIG. 6 is a top view in cross section of the LED tube in FIG. 4.
Figure 7:
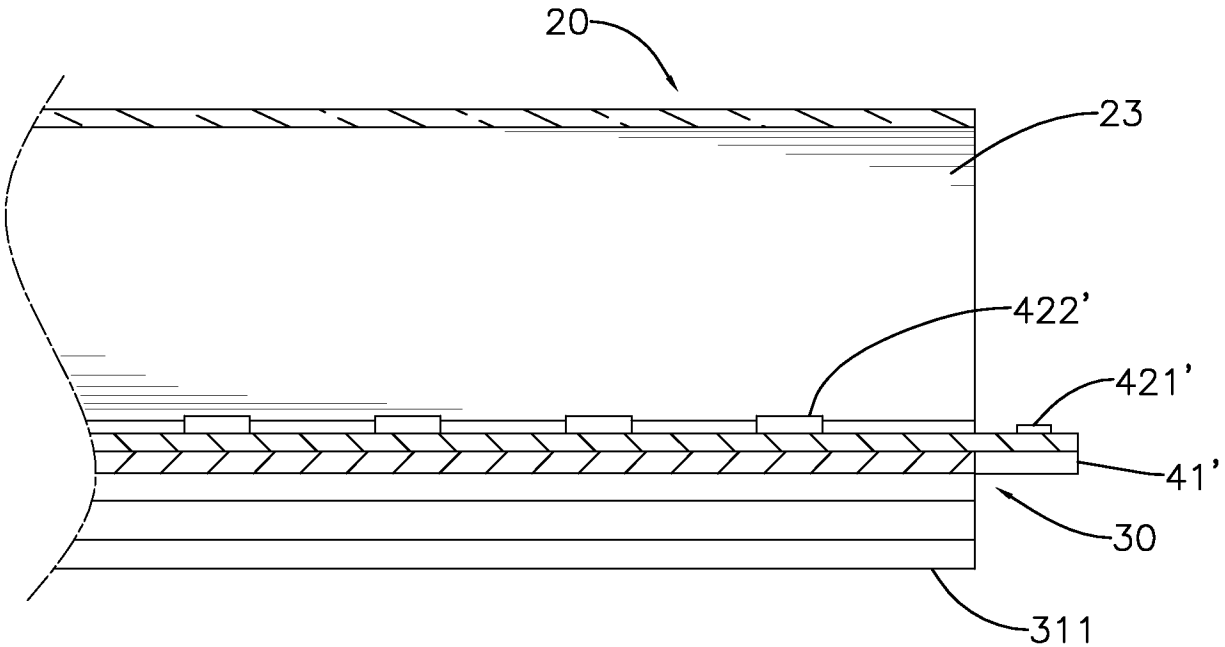
FIG. 7 is a front view in cross section of the LED tube in FIG. 4 without a cap.

With reference to FIGS. 6 and 7, the two opposite ends 43' of the LED light board 40' extend out of the heat dissipating seat 30, thus, distances between the electrical connecting parts 421' mounted on the ends 43' and the heat dissipating seat 30 are extended. Therefore, the creepage distances between the electrical connecting parts 421' and the heat dissipating seat 30 are extended to increase an electrical safety of the LED tube in accordance with the present invention.

Figure 8:
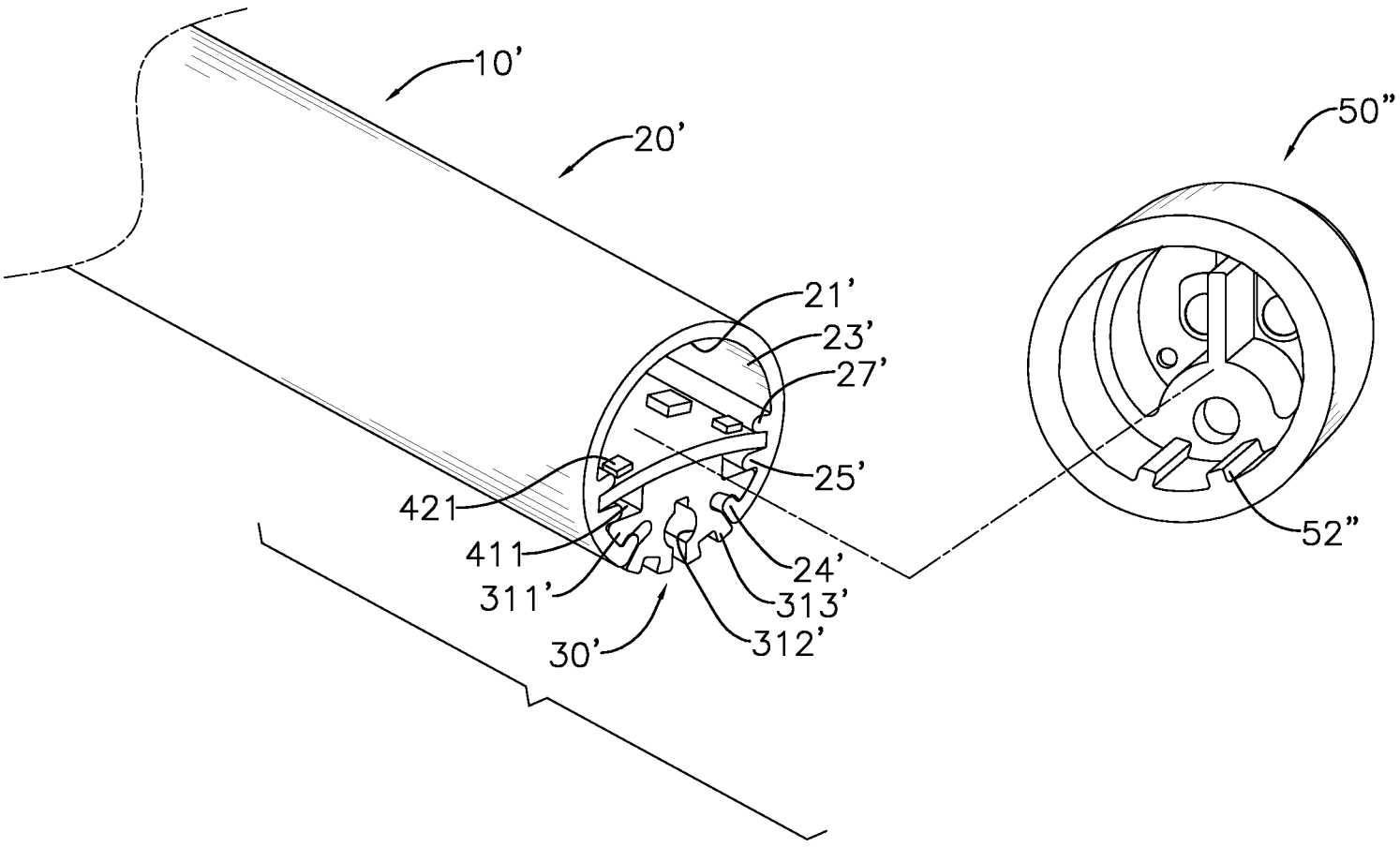
FIG. 8 is a partial exploded view of a third embodiment of an LED tube in accordance with the present invention.
Figure 9:
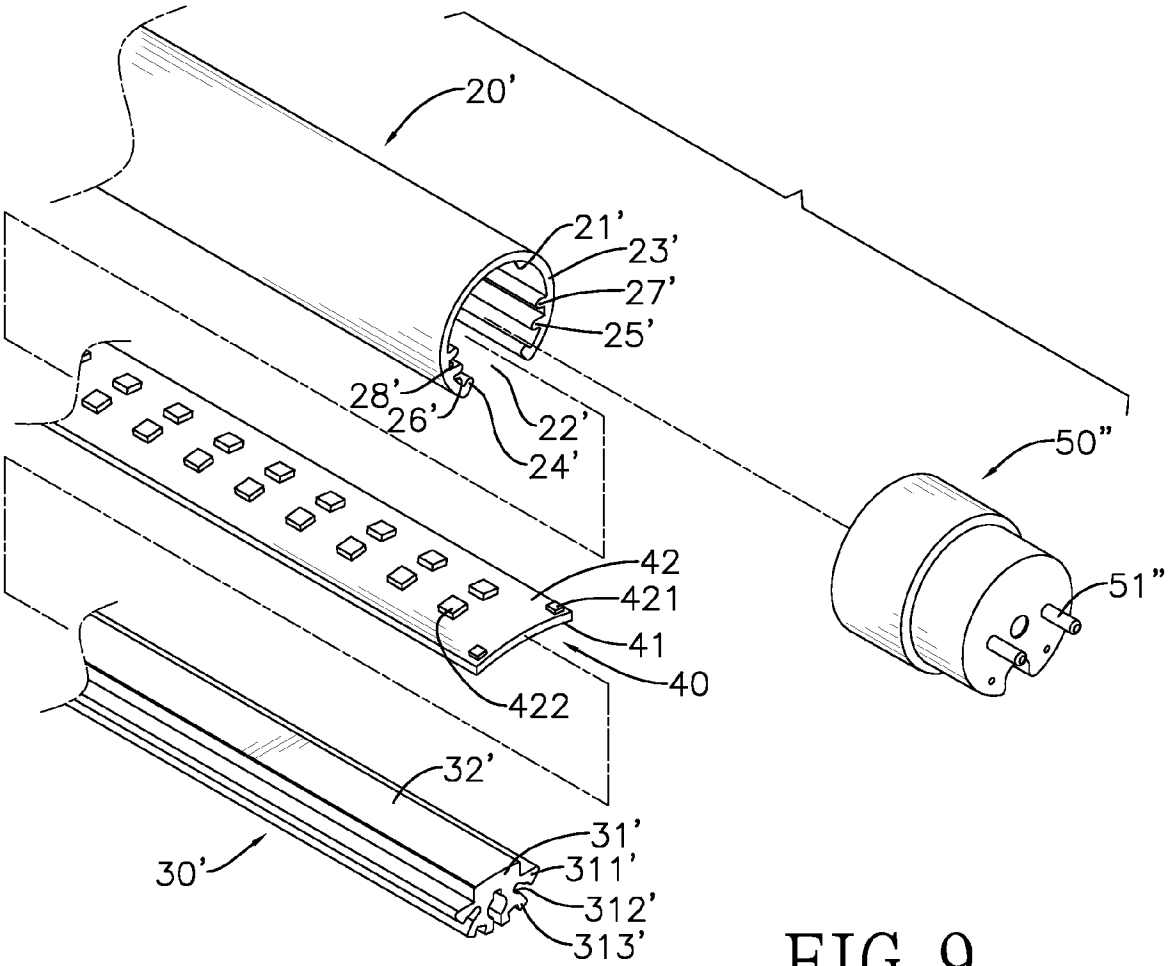
FIG. 9 is an exploded view of the LED tube in FIG. 8.
Figure 10:
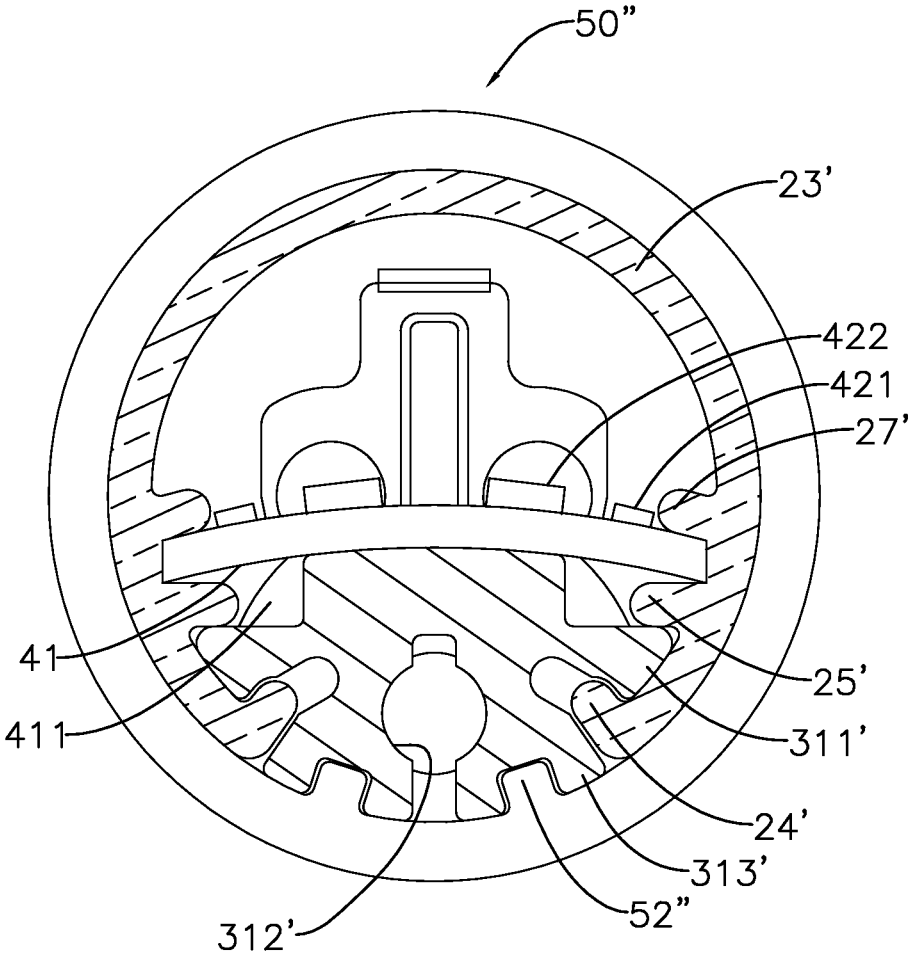
FIG. 10 is a side view in cross section of the LED tube in FIG. 8.
Figure 11:
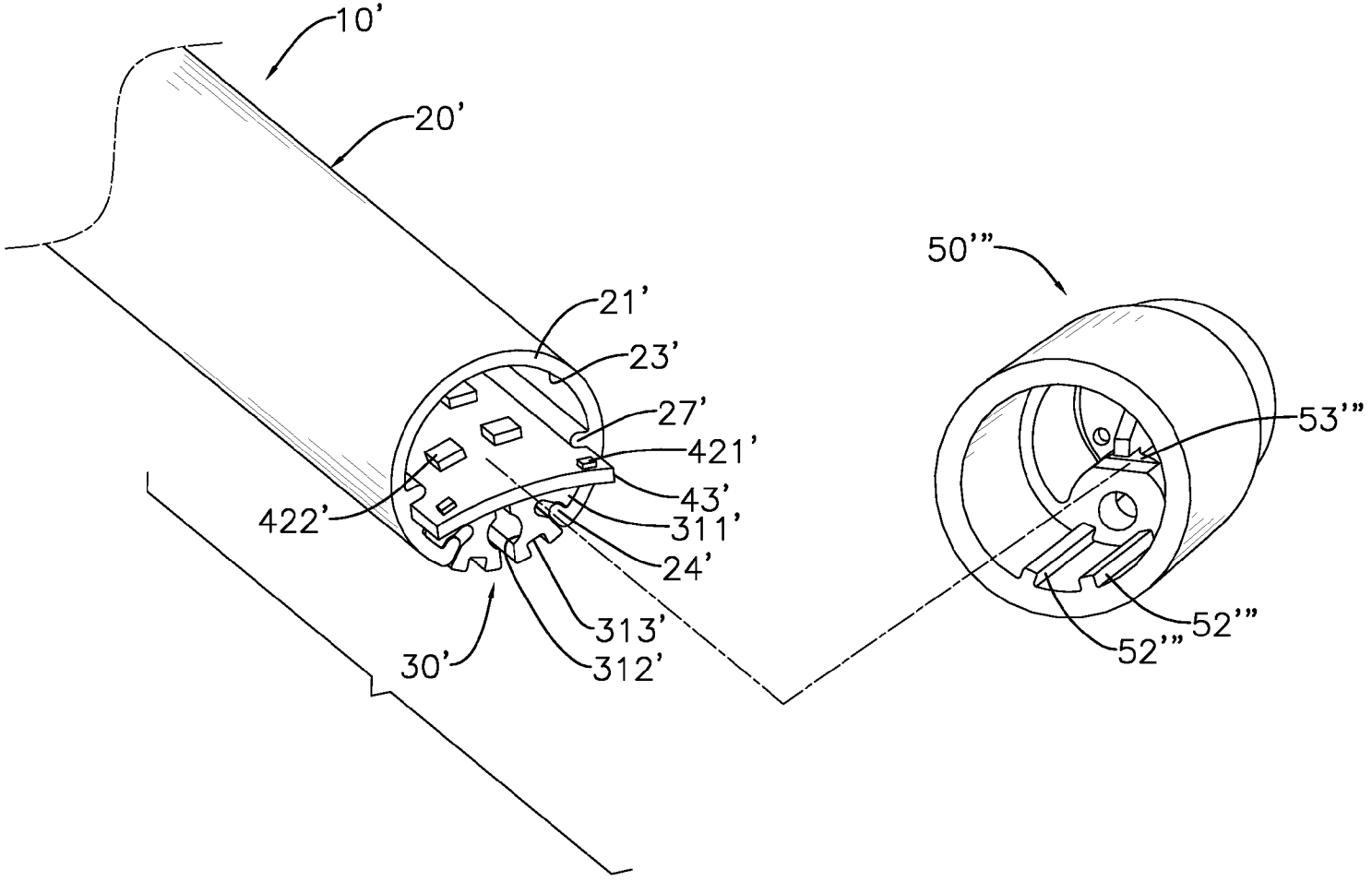
FIG. 11 is a partial exploded view of a fourth embodiment of an LED tube in accordance with the present invention.
Figure 12:
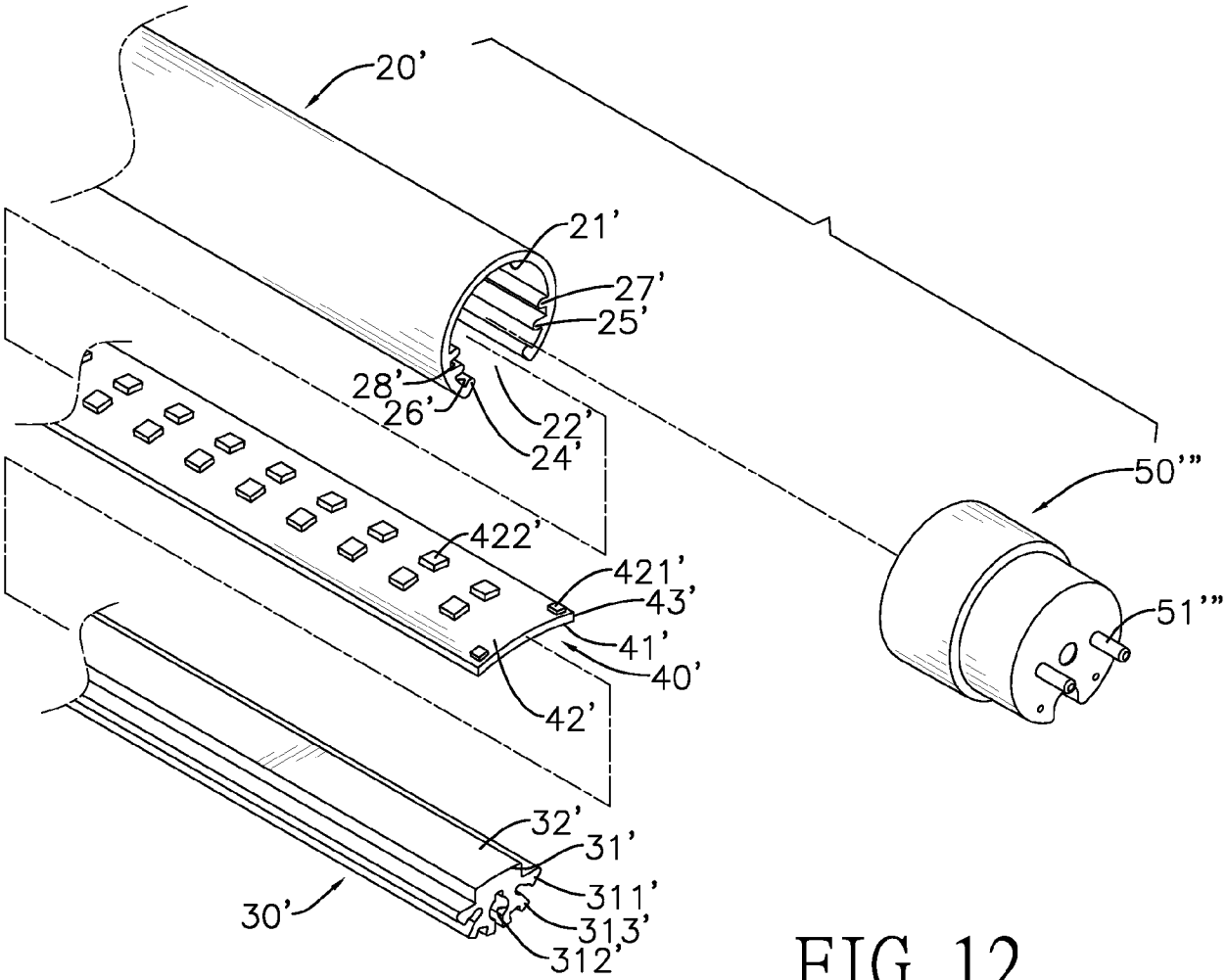
FIG. 12 is an exploded view of the LED tube in FIG. 11.
Figure 13:
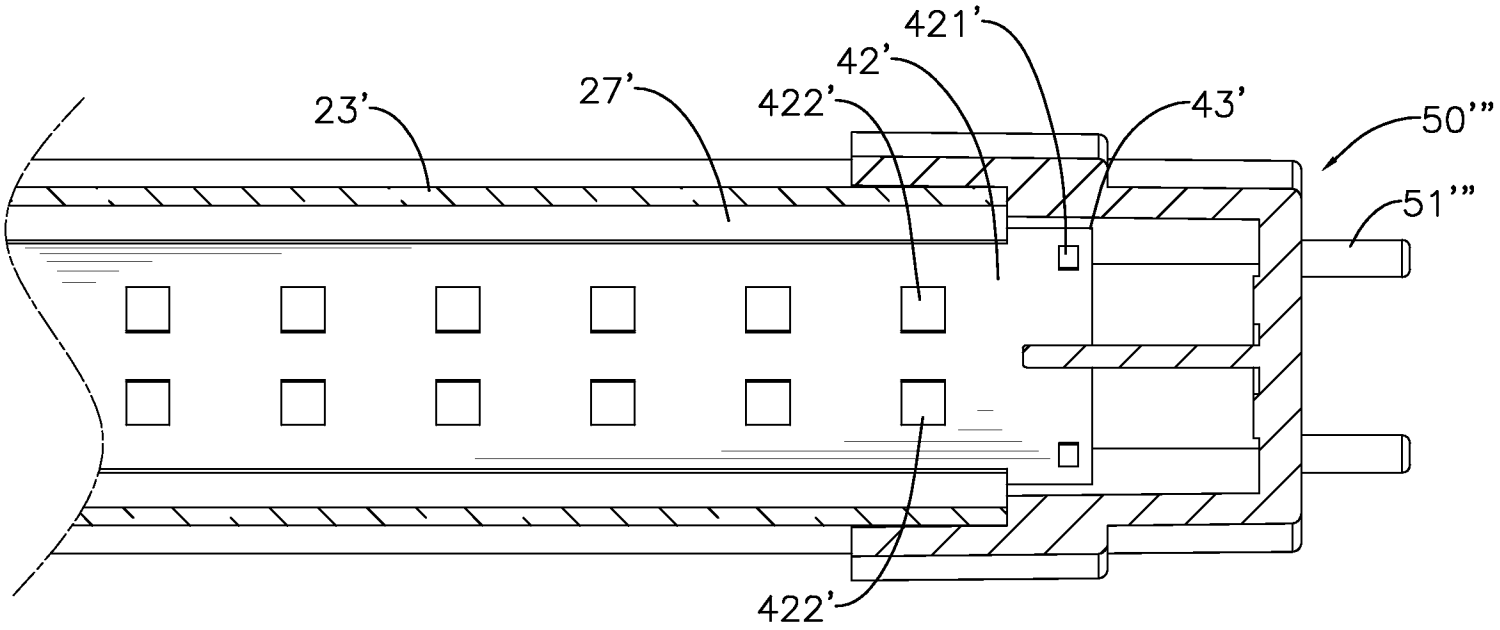
FIG. 13 is a top view in cross section of the LED tube in FIG. 11.
Figure 14:
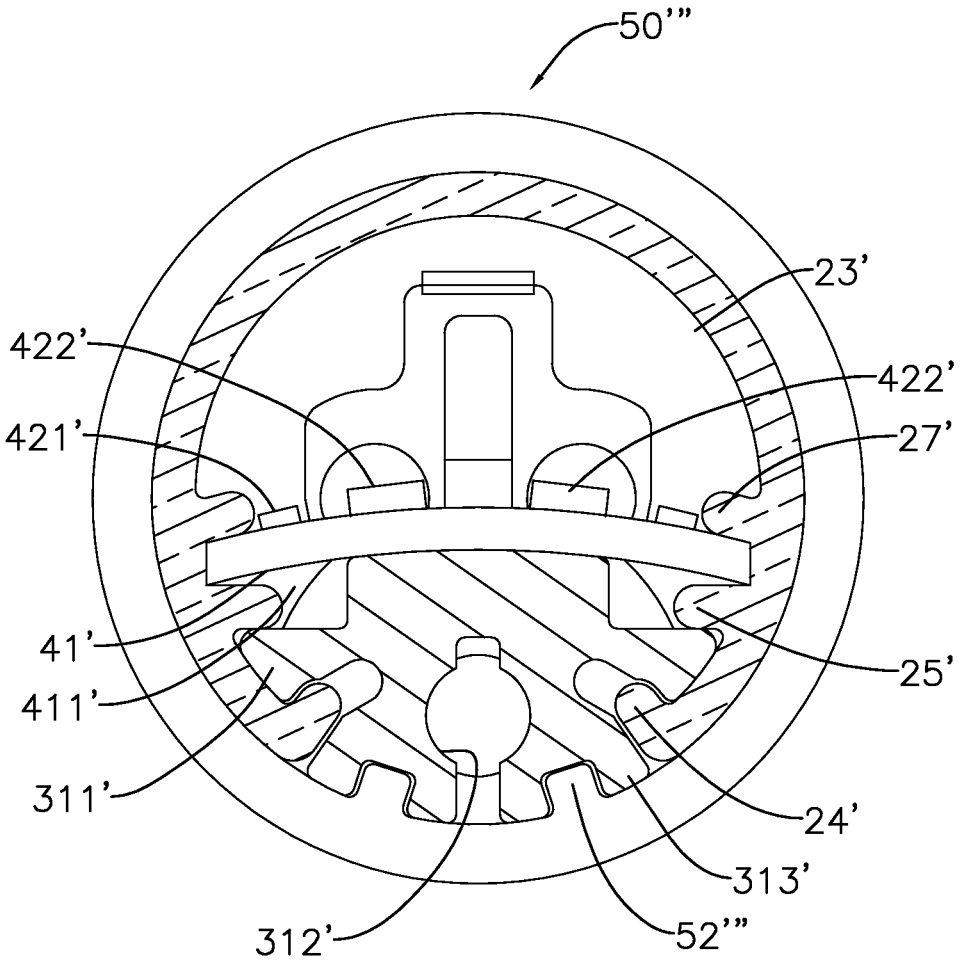
FIG. 14 is a side view in cross section of the LED tube in FIG. 11.
Figure 15:
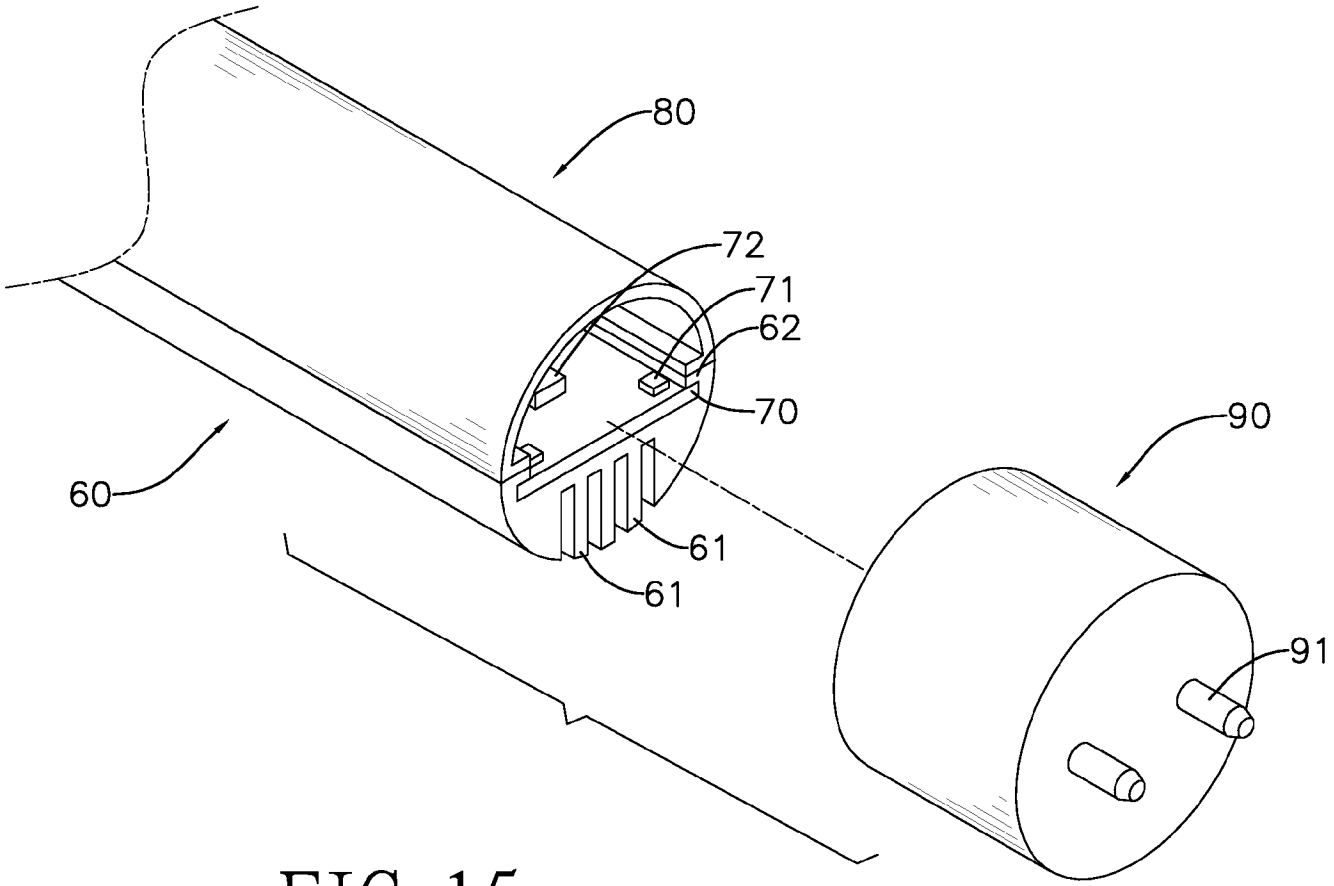
FIG. 15 PRIOR ART
FIG. 15 is a partial exploded view of a conventional LED tube.
Figure 16:
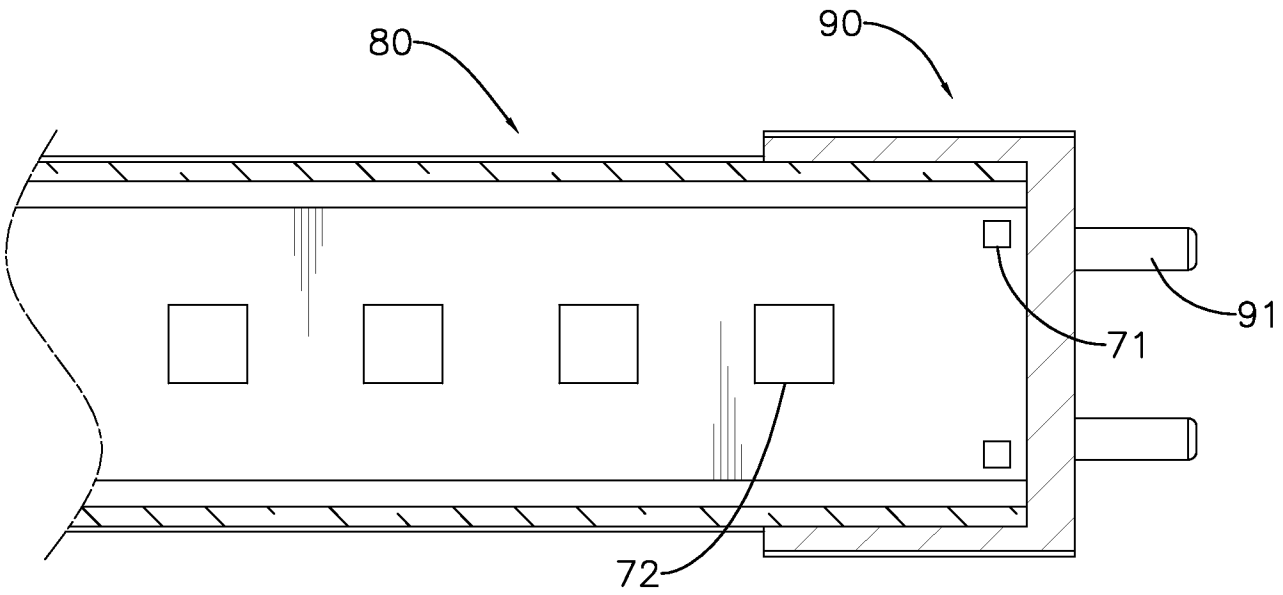
FIG. 16 PRIOR ART
FIG. 16 is a top view in cross section of the conventional LED tube in FIG. 15.

With reference to FIGS. 8 to 10, a third embodiment of an LED tube in accordance with the present invention comprises a tube body 10', an LED light board 40 and two caps 50", wherein structure of the LED light board 40 of the third embodiment is similar to that of the first embodiment. Therefore, descriptions of the structure of the LED light board 40 will not be repeated in the following paragraphs.

The tube body 10' comprises a translucent tube shell 20' and a heat dissipating seat 30'.

The translucent tube shell 20' is electrically insulating and has two openings 21', a gap 22', two side walls 23', two first ribs 24', two second ribs 25', two second slide tracks 26', two third ribs 27' and two first slide tracks 28'. The gap 22' is formed through the translucent tube shell 20' along a longitudinal direction of the translucent tube shell 20'. The two side walls 23' are separated by the gap 22'. The two first ribs 24' are respectively formed on the two side walls 23' and adjacent to the gap 22'. The two second ribs 25' are respectively formed on the two side walls 23', and respectively located above the two first ribs 24'. Each first slide track 26' is formed between a corresponding one of the two side walls 23', the first rib 24' formed on said corresponding side wall 23', and the second rib 25' formed on said corresponding side wall 23'. The two third ribs 27' are respectively formed on the two side walls 23' and respectively located above the two second ribs 25'. Each second slide track 28' is formed between a corresponding one of the two side walls 23', the second rib 25' formed on said corresponding side wall 23', and the third rib 27' formed on said corresponding side wall 23'.

The heat dissipating seat 30' is mounted in the gap 22' of the translucent tube shell 20' and is made of metal. The heat dissipating seat 30' has two opposite sides along a longitudinal direction of the heat dissipating seat 30', a bottom surface 31' and a top convex surface 32' opposite to the bottom surface 31'. The bottom surface 31' faces downward and has two slide bars 311', two fins 312' and two fork parts 313'. The two slide bars 311' extend from the bottom surface 31' and respectively along the two opposite sides of the heat dissipating seat 30', wherein the two slide bars 311' are slidably mounted in the two first slide tracks 26' of the translucent tube shell 20' respectively. Each fin 312' extends downward from the bottom surface 31'. The two fork parts 313 are respectively formed on the two fins 312' to increase radiating areas of the two fins 312'.

In this embodiment, the two opposite sides of the LED light board 40 are slidably mounted in the two second slide tracks 28' of the translucent tube shell 20' respectively.

The caps 50" are respectively sleeved on the two openings 21' of the translucent tube shell 20'. Each cap 50" has an inner wall, two electrode pins 51" and two fin fixing parts 52". The two electrode pins 51" are mounted through the cap 50" and electrically connected to two corresponding ones of the electrical connecting parts 421 respectively. The two fin fixing parts 52" are formed on the inner wall and respectively corresponding in position to the two fork parts 313' of the two fins 312'.

According to the previous paragraph, the two opposite sides of the heat dissipating seat 30' are slidably mounted in the two first slide tracks 26' respectively, and the two opposite sides of the LED light board 40 are slidably mounted in the two second slide tracks 28' of the electrically insulating translucent tube shell 20'. That is, the LED light board 40 is not mounted on the metal heat dissipating seat 30'. Only the concave back surface 41 of the LED light board 40 abuts the top convex surface 32 of the heat dissipating seat 30, and the luminous surface 42 is distal from the heat dissipating seat 30. Therefore, internal creepage distances of the LED tube in accordance with the present invention is extended to avoid a short-circuit between the heat dissipating seat 30 and the LED light board 40 due to short creepage distances.

With reference to FIGS. 11 to 14, a fourth embodiment of an LED tube in accordance with the present invention comprises a tube body 10', an LED light board 40' and two caps 50'''. A structure of the LED light board 40' of the fourth embodiment is similar to that of the second embodiment. A structure of the tube body 10' of the fourth embodiment is similar to that of the third embodiment. Therefore, descriptions of the structure of the tube body 10' and the LED light board 40' will not be repeated in following paragraph.

In this embodiment, the two opposite sides of the LED light board 40' are respectively mounted in the two second slide tracks 28' of the translucent tube shell 20'.

The caps 50''' are respectively sleeved on the two openings 21' of the translucent tube shell 20'. Each cap 50''' has an inner wall, two electrode pins 51''' and two fin fixing parts 52". The two electrode pins 51''' are mounted through the cap 50''' and are electrically connected to two corresponding ones of the electrical connecting parts 421' respectively. The two fin fixing parts 52''' are formed on the inner wall and respectively corresponding to the two fork parts 313' of the two fins 312'. In this embodiment, each cap 50''' further has a board fixing groove 53''' and the board fixing groove 53''' is convex to match the convex LED light board 40', wherein each end 43' of the LED light board 40' is mounted in a corresponding one of the board fixing grooves 53'''.

According to the previous paragraph, the fourth embodiment of the LED tube in accordance with the present invention has advantages of the first, the second and the third embodiments. The two opposite sides of the heat dissipating seat 30' are slidably mounted in the two first slide tracks 26' respectively and the two opposite sides of the LED light board 40' are slidably mounted in the two second slide tracks 28' of the electrically insulating translucent tube shell 20' to avoid a short-circuit between the heat dissipating seat 30' and the LED light board 40'. The two opposite ends 43' of the LED light board 40' extend out of the heat dissipating seat 30' to further extend distances between the electrical connecting parts 421' mounted on the ends 43' and the heat dissipating seat 30'. The two lines of the multiple LED units 422' obliquely face the translucent tube shell 20' and increase an illumination angle of the LED tube in accordance with the present invention.

Above all, all the above-mentioned embodiments of the LED tube in accordance with the present invention have an LED light board 40, 40' having a convex luminous surface 42, 42'. The convex luminous surface 42, 42' is convex toward the translucent tube shell 20, 20'. The multiple LED units 422, 422' mounted on the convex luminous surface 42, 42' are arranged in two lines, wherein the two lines of the LED units 422, 422' are mounted on two beveled faces separated by a midline on the convex luminous surface 42, 42'. The illumination range of the convex luminous surface 42, 42' is increased and further increases an illumination angle of the LED tube in accordance with the present invention. Therefore, the LED tube in accordance with the present invention glows evenly and eliminates grain effects of the LED tube.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An LED tube having an increased illumination angle comprising:

a tube body having:

a translucent tube shell having two openings;

a gap formed through the translucent tube shell along a longitudinal direction of the translucent tube shell;

two side walls separated by the gap; and a heat dissipating seat mounted in the gap;

an LED light board mounted in the tube body and has:

two opposite sides;

two opposite ends connected to the two sides of the LED light board and respectively near the two openings of the translucent tube shell;

a concave back surface abutting the heat dissipating seat; and a convex luminous surface opposite to the concave back surface and facing and convex toward the translucent tube shell; and two caps respectively mounted on the two openings of the translucent tube shell and electrically connected to the LED light board, the two caps each further comprising a board fixing groove formed in the cap, wherein the board fixing groove has a convex curvature corresponding to at least one of the two opposite ends of the LED light board;

wherein the LED light board is longer in a longitudinal direction than the heat dissipating seat in a longitudinal direction and the opposite ends of the LED light board extend beyond the heat dissipating seat for mountable correspondence with the board fixing groove.

2. The LED tube as claimed in claim 1, wherein the convex luminous surface of the LED light board further comprises a midline along a longitudinal direction of the convex luminous surface;

two beveled faces separated by the midline; and multiple LED units arranged in two lines, wherein the two lines of the multiple LED units are respectively mounted on the two beveled faces and along the longitudinal direction of the convex luminous surface.

3. The LED tube as claimed in claim 2, wherein the heat dissipating seat comprises a bottom surface facing downward and having multiple fins extending downward from the bottom surface; and a top convex surface opposite to the bottom surface and corresponding in curvature to the concave back surface of the LED light board.

4. The LED tube as claimed in claim 3, wherein the LED light board further comprises four electrical connecting parts mounted on the convex luminous surface, wherein two of the four electrical connecting parts are respectively mounted near a corresponding one of the two ends of the LED light board, and two of the four electrical connecting parts are electrically connected to a corresponding one of the two caps.

5. The LED tube as claimed in claim 3, wherein each fin of the heat dissipating seat has a fork part formed on the fin; and each cap has multiple fin fixing parts formed in the cap and respectively corresponding to the multiple fork parts of the heat dissipating seat.

6. The LED tube as claimed in claim 3, wherein a length of the LED light board in a width direction of the LED light board is longer than a length of the heat dissipating seat in a width direction of the heat dissipating seat.

7. The LED tube as claimed in claim 2, wherein the LED light board further comprises four electrical connecting parts mounted on the convex luminous surface, wherein two of the four electrical connecting parts are respectively mounted near a corresponding one of the two opposite ends of the LED light board, and two of the four electrical connecting parts are electrically connected to a corresponding one of the two caps.

8. The LED tube as claimed in claim 7, wherein the translucent tube shell further comprises two first slide tracks respectively formed on the two side walls; and two second slide tracks respectively formed on the two side walls, wherein the two second slide tracks are respectively located above the two first slide tracks;

the heat dissipating seat further has two opposite sides slidably mounted in the two first slide tracks of the translucent tube shell respectively; and the two opposite sides of the LED light board are slidably mounted in the two second slide tracks of the translucent tube shell respectively.

9. The LED tube as claimed in claim 2, wherein the translucent tube shell further comprises two first slide tracks respectively formed on the two side walls; and two second slide tracks respectively formed on the two side walls, wherein the two second slide tracks are respectively located above the two first slide tracks;

the heat dissipating seat further has two opposite sides slidably mounted in the two first slide tracks of the translucent tube shell respectively; and the two opposite sides of the LED light board are slidably mounted in the two second slide tracks of the translucent tube shell respectively.

10. The LED tube as claimed in claim 1, wherein the heat dissipating seat comprises a bottom surface facing downward and having multiple fins extending downward from the bottom surface; and a top convex surface opposite to the bottom surface and corresponding in curvature to the concave back surface of the LED light board.

11. The LED tube as claimed in claim 10, wherein the LED light board further comprising four electrical connecting parts mounted on the convex luminous surface, wherein two of the four electrical connecting parts are respectively mounted near a corresponding one of the two ends of the LED light board, and two of the four electrical connecting parts are electrically connected to a corresponding one of the two caps.

12. The LED tube as claimed in claim 11 wherein the heat dissipating seat further comprises two semi-annular grooves respectively formed on two adjacent fins of the multiple fins, wherein the two semi-annular grooves face each other; and each cap further comprises a screw having a screw rod mounted through the cap and between the two semi-annular grooves of the heat dissipating seat; and a screw head connected to the screw rod and abutting the cap.

13. The LED tube as claimed in claim 10, wherein each fin of the heat dissipating seat has a fork part formed on the fin; and each cap has multiple fin fixing parts formed in the cap and respectively corresponding in position to the multiple fork parts of the heat dissipating seat.

14. The LED tube as claimed in claim 10, wherein a length of the LED light board in a width direction of the LED light board is longer than a length of the heat dissipating seat in a width direction of the heat dissipating seat.

15. The LED tube as claimed in claim 10 wherein the heat dissipating seat further comprises two semi-annular grooves respectively formed on two adjacent fins of the multiple fins, wherein the two semi-annular grooves face each other; and each cap further comprises a screw having a screw rod mounted through the cap and between the two semi-annular grooves of the heat dissipating seat; and a screw head connected to the screw rod and abutting the cap.

16. The LED tube as claimed in claim 1, wherein the LED light board further comprises four electrical connecting parts mounted on the convex luminous surface, wherein two of the four electrical connecting parts are respectively mounted near a corresponding one of the two opposite ends of the LED light board, and two of the four electrical connecting parts are electrically connected to a corresponding one of the two caps.

17. The LED tube as claimed in claim 16, wherein the translucent tube shell further comprises two first slide tracks respectively formed on the two side walls; and two second slide tracks respectively formed on the two side walls, wherein the two second slide tracks are respectively located above the two first slide tracks;

the heat dissipating seat further has two opposite sides slidably mounted in the two first slide tracks of the translucent tube shell respectively; and the two opposite sides of the LED light board are slidably mounted in the two second slide tracks of the translucent tube shell respectively.

18. The LED tube as claimed in claim 1, wherein the translucent tube shell further comprises two first slide tracks respectively formed on the two side walls; and two second slide tracks respectively formed on the two side walls, wherein the two second slide tracks are respectively located above the two first slide tracks;

the heat dissipating seat further has two opposite sides slidably mounted in the two first slide tracks of the translucent tube shell respectively; and the two opposite sides of the LED light board are slidably mounted in the two second slide tracks of the translucent tube shell respectively.

* * * * *